US005788197A

United States Patent [19]

Tutela

[11] Patent Number: 5,788,197

[45] Date of Patent: Aug. 4, 1998

[54] GOLF ASSEMBLY WITH CIGAR HOLDING FEATURES

[76] Inventor: Rocco R. Tutela, 405 Northfield Ave. - Suite 100, West Orange, N.J. 07052

[21] Appl. No.: 662,790

[22] Filed: Jun. 12, 1996

[51] Int. Cl.[6] ..... A45F 3/44; A24F 9/14; A63B 57/00

[52] U.S. Cl. ..... 248/156; 248/689; 248/176.1; 473/282; 473/286; 473/406; 473/408; 131/257; 131/259; 131/329; 224/918

[58] Field of Search ..... 248/156, 682, 248/689, 690, 316.7, 68.1, 176.1; 473/282, 286, 406, 408; 224/918, 269, 271; 220/405; 206/236, 567; 131/257, 259, 329; 211/70.3

[56] References Cited

U.S. PATENT DOCUMENTS

| | | | |
|---|---|---|---|
| D. 165,253 | 11/1951 | Ward | 224/918 X |
| D. 272,461 | 1/1984 | Burns | D21/234 |
| D. 306,057 | 2/1990 | Baughan, Jr. | D21/234 |
| D. 375,815 | 11/1996 | Kagasoff | D7/183 |
| 842,613 | 1/1907 | Bigelow | 211/70.3 X |
| 1,816,301 | 7/1931 | Sundell | 248/68.1 X |
| 1,995,370 | 3/1935 | Walters | 248/68.1 |
| 2,536,725 | 1/1951 | Cleveland | 224/918 X |
| 2,650,595 | 9/1953 | Harkins . | |
| 3,185,483 | 5/1965 | Klynman | 473/286 |
| 4,007,928 | 2/1977 | Doubt . | |
| 4,063,731 | 12/1977 | Kitay | 473/408 X |
| 4,475,676 | 10/1984 | Smith | 224/247 |
| 4,535,987 | 8/1985 | Dikoff . | |
| 4,627,621 | 12/1986 | Tate . | |
| 4,960,239 | 10/1990 | Wait . | |
| 4,960,278 | 10/1990 | Hainey . | |
| 4,974,842 | 12/1990 | Widman | 473/406 |
| 4,984,790 | 1/1991 | Dowdy et al. . | |
| 5,022,650 | 6/1991 | Madock . | |
| 5,116,046 | 5/1992 | Pace | 473/286 |
| 5,143,371 | 9/1992 | Strahan . | |
| 5,160,134 | 11/1992 | McDonald . | |
| 5,226,647 | 7/1993 | Notarmuzi . | |
| 5,292,120 | 3/1994 | Pehoski et al. . | |
| 5,305,999 | 4/1994 | Tate . | |
| 5,401,019 | 3/1995 | Wissman et al. | 473/286 |
| 5,405,133 | 4/1995 | Upton . | |
| 5,433,436 | 7/1995 | Hoyt et al. | 473/406 |
| 5,529,299 | 6/1996 | Bellagamba | 473/286 X |
| 5,588,448 | 12/1996 | Photakis | 131/259 |

*Primary Examiner*—Ramon O. Ramirez
*Assistant Examiner*—Stephen S. Wentsler
*Attorney, Agent, or Firm*—Anthony J. Casella; Gerald E. Hespos; Ludomir A. Budzyn

[57] ABSTRACT

A golf accessory is provided for supporting a cigar in spaced relationship to the turf for preventing the cigar from contacting chemicals applied to the turf. The accessory includes a bottom supporting surface for placement on the turf. The accessory further includes a top surface characterized by at least one array of corrugations. Each array of corrugations includes an arcuately concave corrugation extending entirely across the accessory and a pair of arcuately convex corrugations on opposite respective sides of the concave corrugations. The concave corrugation has a radius dimensioned to support a cigar of a selected ring size.

12 Claims, 2 Drawing Sheets

GOLF ASSEMBLY WITH CIGAR HOLDING FEATURES

BACKGROUND OF THE INVENTION

1. Field of the Invention

The subject invention relates generally to a multi-purpose tool to enable a golfer to safely support a cigar while playing a golf ball.

2. Description of the Prior Art

Golf continues to be a very popular sport throughout the world. It is envisioned that golf will become even more popular as the baby boom generation finds tennis, jogging and other more active sports to be too demanding on their knees and elbows.

Golfers invest heavily in equipment. Even occasional golfers own a golf bag stocked with at least twelve clubs, an umbrella, a ball retriever, balls, tees, golf shoes, spike cleaners and towels. Most golfers also carry one or two handy tools for use on the golf course. For example, many golfers carry a tool to repair ball marks and divots. A ball mark is a small crater caused when a highly lofted golf ball lands on a soft section of turf. A divot is damage caused to the turf when the head of a golf club hits under a ball. Most divots include a region where a section of turf and the top soil adjacent thereto is compressed and moved from a planar condition into a non-planar condition that may include a small bump, a depression or both. Most courses require golfers to repair their own ball marks and divots. The repair procedure requires the golfer to replace any patch of turf that has been completely removed and to flatten turf that has been deformed into a bump, a depression or both. This repair task is facilitated by a tool having prongs that can be slid under the partly displaced section of turf to flatten the turf into its initial planar configuration.

To reduce clutter in the golf bag and in the golfers pocket, turf repair tools often are combined with other tools. For example, U.S. Pat. No. 4,007,928 shows a turf repair tool that also functions as a shoe horn and that releasably receives a ball marker. U.S. Pat. No. 4,535,987 shows a turf repair tool with an integral score keeper, a spike tightener and a bottle opener. U.S. Pat. No. 4,960,239 shows a turf repair tool with a ball marker and with clips for releasably receiving golf tees. The tool in U.S. Pat. No. 4,960,239 also is configured for releasable engagement on the belt of the golfer for easy access. U.S. Pat. No. 4,984,790 shows a turf repair tool with three tines and with a handle having thumb and finger depressions to facilitate manipulation of the tool.

U.S. Pat. No. 4,627,621 shows a tool with a pair of tines projecting in one direction for repairing a region of turf. A concave edge is defined on a portion of the tool facing away from the tines. This tool can be used by pressing the tines into the ground such that the concave edge is facing upwardly. The concave edge then can be used to support the handle of a golf club in a slightly raised disposition relative to the ground. Hence, the handle of the golf club can be kept dry.

U.S. Pat. No. 5,143,371 shows a turf repair tool with a concave edge for supporting the handle of a golf club in a manner similar to the above referenced U.S. Pat. No. 4,627,621. This tool also includes features for hooking the tool onto the belt of the golfer and for releasably engaging a golf glove. U.S. Pat. No. 5,292,120 also shows a tool with a pair of turf repair tines, a concave edge for supporting the grip of a golf club and features for cleaning and tightening cleats on a golf shoe.

U.S. Pat. No. 5,305,999 shows a golf tool with many of the features referred to above. Additionally, the edge of the tool opposite the tines includes a circular notch dimensioned to releasably hold a cigarette. Thus, the tines of the tool can be urged into the turf and a cigarette can be frictionally clipped in the upwardly facing recess to hold the cigarette while the golfer is playing a ball. A tool with similar features is shown in U.S. Pat. No. 5,226,647.

The incorporation of cigarette holding features into a golf tool as shown in the two preceding references, may reflect the fact that a golf course is one of the few public places where cigarette smoking is still permitted. The incorporation of cigarette holding features into a golf tool can be achieved without great difficulty. In particular, virtually all cigarettes are of the same diameter. Hence, a recess dimensioned to releasably engage one cigarette will hold virtually any cigarette. Additionally, cigarettes are relatively light and do not vary greatly in their length. Thus, it is fairly easy to support a cigarette in the recess as shown in either of the two preceding patents. A cigarette could be fairly easily damaged by exerting excessive force as the cigarette is being inserted into the notch of the prior art golf tool or being removed therefrom. A cigarette also might be damaged if forces on the cigarette were at an improper angle relative to the tool. However, cigarettes are inexpensive, and most cigarette smokers would accept the risk of an occasionally broken cigarette for the convenience of using one of the tools shown in the preceding two patents.

The baby boom generation, that is increasingly pursuing golf, also has become increasingly health conscious. The health risks of cigarette smoking are well documented. Hence, cigarette smoking among mature adults has decreased significantly. Simultaneously, cigar smoking has become considerably more popular. Cigars are not inhaled and hence do not carry the significant risk of respiratory of pulmonary disease. The absence of inhalation substantially eliminates the potential of nicotine addition. Hence cigar smokers typically smoke less often than cigarette smokers.

Cigars differ from cigarettes in other significant respects as well. For example, virtually all cigars have significantly greater lengths and significantly greater diameters than cigarettes. Furthermore, the lengths and the diameters, or ring sizes, vary significantly from one cigar to the next. Many cigars also are of non-circular cross-sectional shape. Cigars also differ significantly from cigarettes in price. Whereas a pack of twenty cigarettes may cost in the $2.00–$3.00 range, a single hand made cigar will cost at least $5.00, and a high quality cigar may cost three to five times that amount. Thus, while cigarette smokers may carelessly treat each cigarette, a cigar smoker exercises considerable care.

Cigars also differ from cigarettes in the characteristics of the outer wrapper. Cigarettes are formed by placing shredded tobacco leaves into a paper tube. Cigars, on the other hand, include an outer wrapper formed from carefully selected tobacco leaves. Transverse forces on the outer surface of a cigar easily can break or delaminate the outer wrapper of the cigar. A clip may be an acceptable means of holding a cigarette. However the vast differences in cigar ring sizes and the fragile nature of the cigar outer wrapper makes a clip or some other close gripping of a cigar unacceptable.

Golfing is an ideal time to smoke a cigar for several reasons. In particular, it may take at least one half hour to smoke a cigar. A round of golf often is one of the few times when a cigar smoker has the opportunity to smoke an entire cigar.

Smoking a cigar while playing a ball typically is not feasible. In most instances, the golfer will merely place the lit cigar on the turf while addressing the ball. He will then pick up the cigar from the turf and continue smoking until he again must address the ball.

The health concerns that have lead many people away from cigarettes also have made many people aware of the chemicals used in our environment. Pesticides, herbicides and a broad range of chemical fertilizers are used regularly on golf courses. Thus, a cigar smoker who places the moist end of a cigar on the turf is almost certain to be ingesting these chemicals when he again places the cigar in his mouth. Of course, it is impractical for a cigar smoker to carry an ashtray in the golf bag, and none of the prior art golf tools address this problem.

In view of the above, it is an object of the subject invention to provide a golf accessory for safely supporting a cigar in spaced relationship to the chemically treated turf of a golf course.

It is another object of the subject invention to provide an accessory that can support a cigar without damaging the fragile outer wrapper of the cigar.

It is a further object of the subject invention to provide an accessory that can easily support cigars of different lengths and different ring sizes.

Yet another object of the subject invention is to provide an accessory for supporting a cigar that can be combined with other golf related tools to minimize the clutter in a golf bag.

SUMMARY OF THE INVENTION

The subject invention is directed to a golf accessory with cigar holding features, and particularly with structure for holding at least the unlit end of a cigar in spaced relationship to the turf. The accessory includes at least one support surface and a plurality of corrugations on a portion of the accessory opposite the support surface. The corrugations comprise at least one elongate concave corrugation which may be generated about an axis generally parallel to the support surface of the accessory. The base of the concave corrugation is spaced from the support surface of the accessory, and hence is spaced from a region of turf on which the support surface of the accessory may be placed.

The concave corrugation in the accessory preferably defines a diameter greater than the diameter of the largest cigar that is likely to be smoked (e.g., ring size 56). The concave corrugation preferably defines a length sufficient to support the cigar. For example, the concave corrugation of the accessory may be approximately 1.0"–2.0" long.

The concave corrugation preferably is adjacent a pair of convex corrugations. The convex corrugations may be smoothly arcuately convex to ensure that peaks of the convex corrugations do not damage the outer wrapper of the cigar as the cigar is being placed into the concave corrugation.

The above referenced corrugations may define a first array of corrugations. The accessory may further include a second array of corrugations intersecting the first array and, for example, orthogonal to the first array of corrugations. The second array of corrugations also are spaced from and preferably parallel to the support surface of the accessory. The provision of a second array of corrugations affords the cigar smoker further options for supporting the cigar. Additionally, the corrugations in the second array may be differently dimensioned than the corrugations in the first array. Thus, for example, the corrugations in the first array may be dimensioned for supporting a smaller ring size, while the corrugations in the second array may be dimensioned for supporting a larger ring size.

The support surface of the accessory may be generally planar. Alternatively, the support surface may include at least a third array of corrugations that may be the same as or different from the corrugations in the first or second arrays. Thus, either of the two opposed surfaces of the accessory may function as the support surface, and either of the opposed surfaces of the accessory may function as a cigar support.

The accessory of the subject invention may further include at least one tool portion for performing a golf related function. For example, the accessory may include a pair of tines for repairing ball marks and divots. The accessory may further include a ball marker removably retained therein. The accessory may further include a slot between the opposed surfaces thereof for releasably engaging the golfer's belt to ensure ready accessibility.

DETAILED DESCRIPTION OF THE PREFERRED EMBODIMENT

Figure 1:
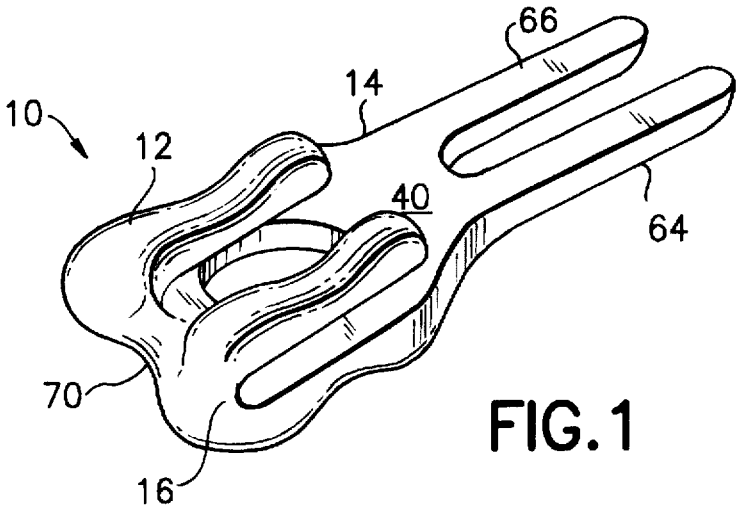
FIG. 1 is a perspective view of a golf accessory in accordance with the subject invention.

A golf accessory in accordance with the subject invention is identified generally by the numeral 10 in FIGS. 1–7. The accessory 10 includes a top support wall 12, a bottom support wall 14, and a connecting wall 16 for maintaining the top and bottom support walls 12 and 14 in spaced relationship. More particularly, top and bottom support walls 12 and 14 are spaced from one another by distance "a" of approximately ⅛"–¼" to enable a belt, strap or the like to be slidably received in space 18. Additionally, the support wall 16 may be constructed to provide slight resiliency between top and bottom walls 12 and 14 to accommodate belts, straps or the likes of slightly different dimensions in space 18 and to achieve a resilient gripping on a belt, strap or the like in space 18.

Top wall 12 includes a substantially planar bottom surface 20 and a corrugated top surface 22. More particularly, corrugated top surface 22 includes an array of transverse top corrugations comprising transverse top convex corrugations 24 and 26 and a transverse top concave corrugation 28 therebetween. Transverse top corrugations 24, 26 and 28 are generated about axes that extend substantially parallel to planar bottom surface 20 of top wall 12. Transverse top corrugations 24, 26 and 28 are depicted as being substantially sinusoidally generated, such that transverse top concave corrugation 28 is substantially a mirror image of transverse top convex corrugations 24 and 26. However, conformity between the convex and concave corrugations is not essential. Rather, a first critical dimension requires transverse top concave corrugation 28 to have a sufficiently large diameter for receiving a cigar with the maximum ring size that is likely to be smoked by the golfer. For example, transverse top concave corrugation 28 may define a radius of approximately 0.5". The transverse top convex corrugations 24 and 26 should be sufficiently rounded to ensure that a cigar being placed in the transverse top concave corrugation 28 is not damaged by inadvertent contact with either of the transverse top convex corrugations 24 and 26. Thus, for example, the transverse top convex corrugations 24 and 26 may define radii that are slightly smaller than the transverse top concave corrugation 28. As illustrated most clearly in FIGS. 1 and 3, the transverse top concave corrugation 28 extends entirely across accessory 10 to ensure efficient use of the entire width of accessory 10 for supporting a cigar in the transverse top concave corrugation 28, as shown in FIG. 1.

Figure 6:
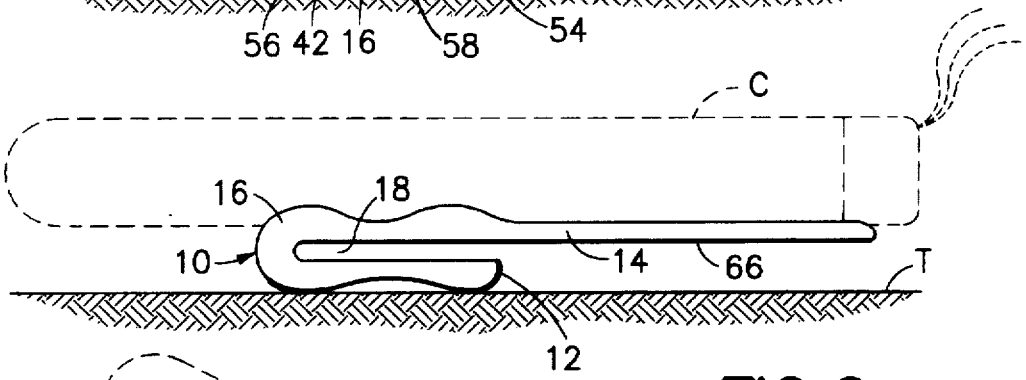
FIG. 6 is a side elevational view showing the accessory used in a manner different from the view shown in FIG. 1.

The top surface 22 of the top wall 12 further includes an array of longitudinal corrugations comprising longitudinal top convex corrugations 34 and 36 and a longitudinal top concave corrugation 38 therebetween. As shown most clearly in FIG. 4, the longitudinal top corrugations 34, 36 and 38 are substantially similar to the transverse top corrugations 24, 26 and 28 described above. Thus, a cigar may be supported in the longitudinal top concave corrugation 38 in substantially the same way as it can in the transverse top concave corrugation 28, and as shown in FIG. 6.

The top wall 12 as shown most clearly in FIG. 1 includes a cut out portion 39 extending into the edge regions thereof most distant from the connecting wall 16. A cut out 39 is provided to ensure access to regions of the bottom wall 14 directly opposite central regions of the top wall 12. As explained further herein, a golf marker is releasably engaged in the bottom wall 14, and removal may be effected by inserting digital pressure through the cut out 39. The cut out 39 and the ball marker described below are both optional features of the accessory 10. The provision of the cut out 39 does not affect the cigar supporting features of the accessory. In particular, a cigar supported in the top longitudinal concave corrugation 38 is supported by portions of the top wall 12 adjacent the supporting wall 16 and by portions of the top wall 12 on either side of the cut out 39. Additionally, portions of the bottom wall 14 spaced longitudinally from the top wall 12 may contribute to cigar supporting functions in certain instances.

The bottom wall 14 includes a planar top surface 40 and an opposed corrugated bottom surface 42. The corrugated bottom surface 42 is substantially similar to the corrugated surface 22 of the top wall 12 as described in detail above. More particularly, the corrugated bottom surface 42 includes an array of transverse bottom corrugations including transverse bottom convex corrugations 44 and 46 and a transverse concave corrugation 48 disposed therebetween. Relative shapes and dimensions of the transverse bottom corrugations 44, 46 and 48 may be substantially the same as those described above with respect to the transverse top corrugations 24, 26 and 28. In particular, the transverse bottom concave corrugation 48 extends continuously across the entire accessory 10 to enable efficient supporting of a cigar therein without risk of damage to the cigar by either of the transverse bottom convex corrugations 44 and 46.

The bottom wall 14 also is provided with longitudinal bottom corrugations, including longitudinal bottom convex corrugations 54 and 56 and a longitudinal bottom concave corrugation 58 therebetween. The longitudinal bottom corrugation 54, and 58 are dimensionally and functionally similar to the top corrugations described above.

The bottom wall 14 is further provided with a circular aperture 60 which releasably frictionally receives a ball marker 62. The ball marker 62 may be disengaged from the bottom wall 14 by digitally directed pressure on the ball marker 62 through the cut out 39 in the top wall 12.

The bottom wall 14 further includes a pair of elongate tines 64 and 66 projecting in spaced relationship to one another away from the connecting wall 16. The tines 64 and 66 are used to repair ball marks and divots in the turf.

Figure 2:
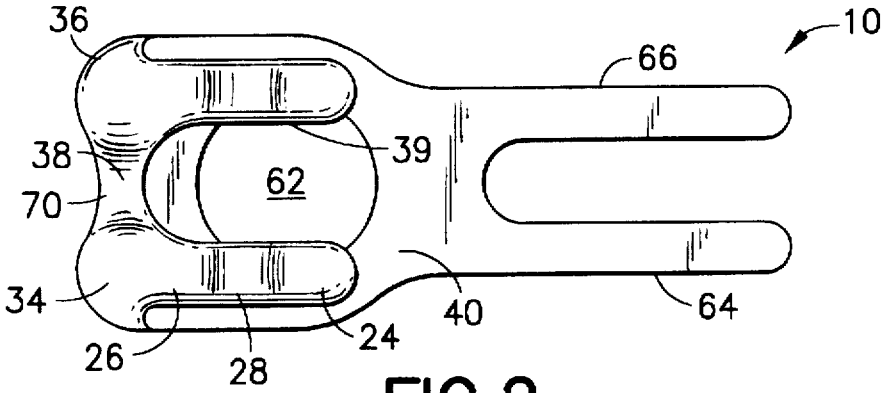
FIG. 2 is a top plan view of the accessory shown in FIG. 1.
Figure 3:
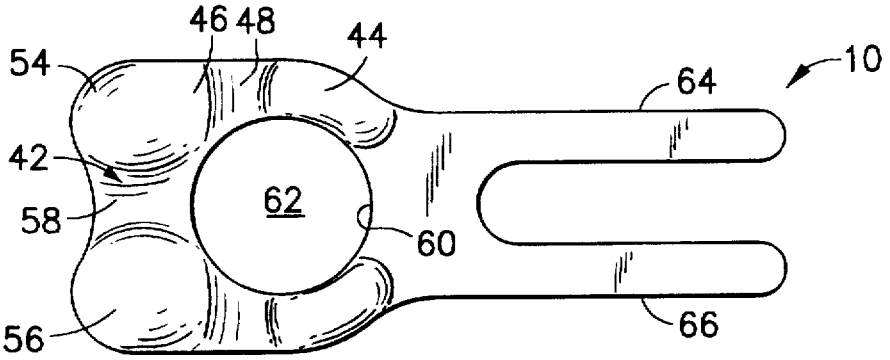
FIG. 3 is a bottom plan view thereof.
Figure 4:
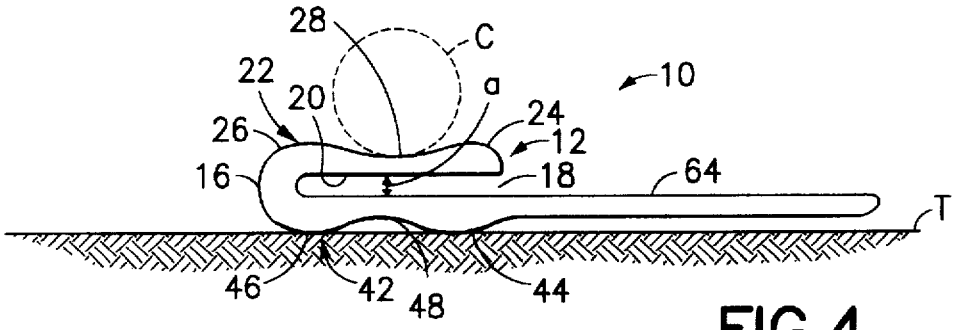
FIG. 4 is a front elevational view of the accessory.

As shown most clearly in FIGS. 1 and 2, the connecting wall 16 includes an outwardly facing concave surface 70 defining a radius equal to or slightly greater than the largest cigar ring size that is likely to be smoked.

Figure 5:
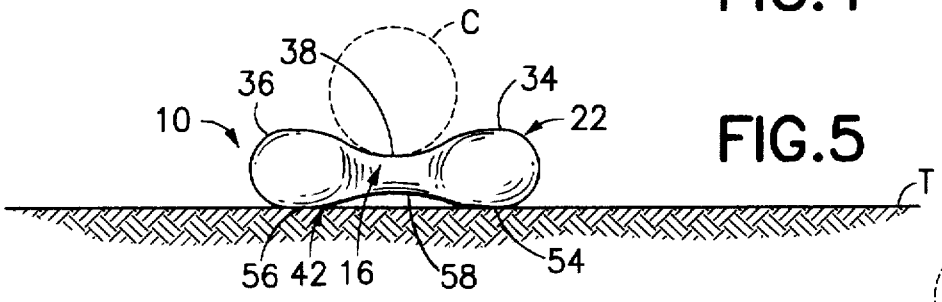
FIG. 5 is a side elevational view as viewed from the left side of FIG. 2.
Figure 7:
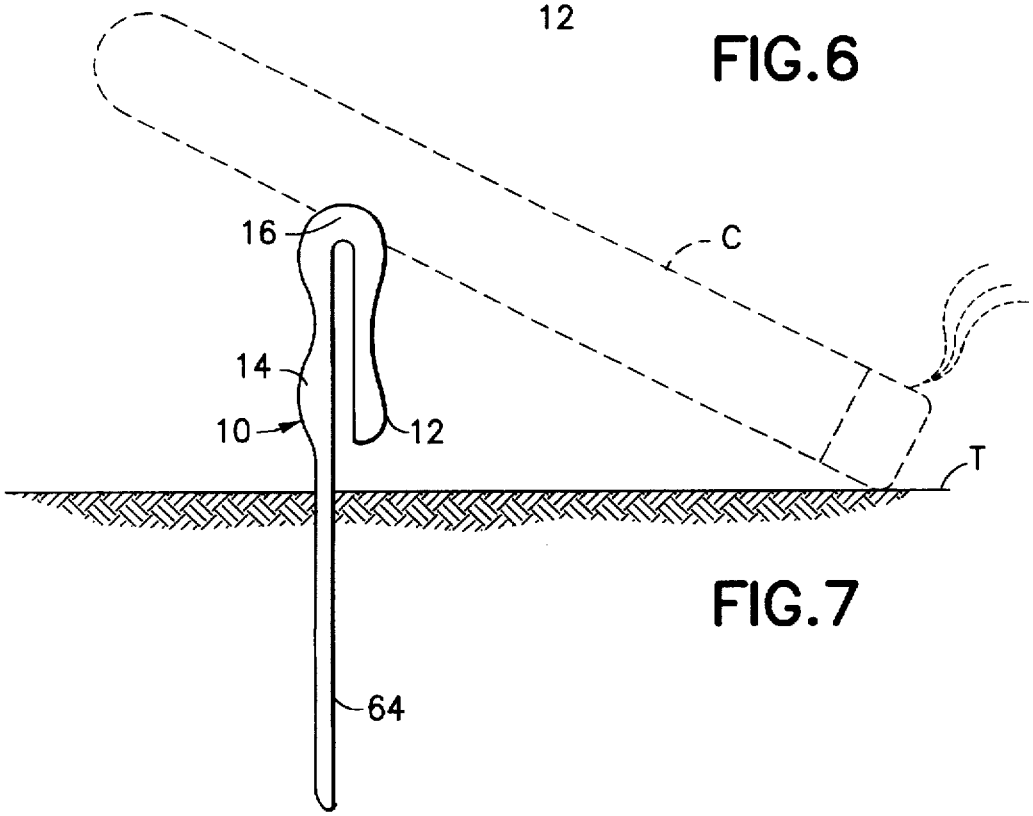
FIG. 7 is a side elevational view showing the accessory used in still a different orientation.

The accessory 10 may be used as shown in FIGS. 5–7. More particularly, the accessory 10 may merely be tossed onto a convenient region of turf T. The accessory 10 may land with the bottom wall 14 down and in supporting engagement on the turf T as shown in FIG. 5. A golfer may then place a cigar C in supporting engagement in the transverse top concave corrugation 28 such that end regions of the cigar C are spaced from the turf T and separated from any chemicals with which the turf T may have been treated. In a similar manner, the cigar C could be placed in the longitudinal top concave corrugation 38. In certain embodiments, a selection of either transverse or longitudinal top concave corrugations 28 or 38 may be dictated by the relative ring sizes to which these corrugations are formed.

FIG. 6 shows the accessory 10 supported on the top wall 12 after a similar casual toss by the golfer. The cigar C similarly is supported in the bottom transverse concave corrugation 48 in this orientation of the accessory 14. The cigar C also optionally could be supported in the longitudinal bottom concave corrugation 58 in this orientation of the accessory 10.

The accessory 10 may alternatively be used by urging the tine 64 and 66 into the turf as shown in FIG. 7. The unlit end of the cigar C may then be supported in the concave region of connecting wall 16.

What is claimed is:

1. A golf accessory comprising an elongate bottom wall having first and second opposed longitudinal ends and a bottom surface extending therebetween; a connecting wall extending upwardly from said first end of said bottom wall; and a top wall projecting from said connecting wall in spaced substantially parallel relationship to said bottom wall, said top wall comprising a top surface facing away from said bottom wall, said top surface of said top wall comprising a first array of top corrugations thereon, said first array of top corrugations comprising a first concave top corrugation and a first pair of arcuately convex top corrugations on opposite respective sides of said first top concave corrugation said first concave top corrugation and said first pair of arcuately convex top corrugations being generated about a first array of axes that are parallel to one another and that define a plane aligned substantially transverse to said elongate bottom wall, said top wall further comprising a second array of top corrugations generated about a second array of axes orthogonally aligned to the axes of said first array of top corrugations, said second array of top corrugations comprising a second concave top corrugation extending continuously across said top wall and a second pair of arcuately convex top corrugations disposed respectively on opposite respective sides of said second concave top corrugation.

2. The accessory of claim 1, wherein the first top concave corrugation is dimensioned differently from said second top concave corrugation.

3. The accessory of claim 1, wherein said bottom wall further comprises a pair of tines projecting from portions of said bottom wall opposite said connecting wall.

4. The accessory of claim 1, wherein said bottom wall further includes a ball marker removably engaged therein.

5. The accessory of claim 1, wherein said connecting wall includes a concave outwardly facing surface.

6. A golf accessory comprising an elongate bottom wall having first and second opposed longitudinal ends and a bottom surface extending therebetween, said bottom surface of said bottom wall including a first array of bottom corrugations, said first array of bottom corrugations comprising a first bottom concave corrugation extending continuously across said bottom wall and a first pair of arcuately convex bottom corrugations disposed respectively on opposite sides of said first concave bottom corrugation, said first array of bottom corrugations being generated about a first array of bottom corrugation axes that are substantially parallel to one another, said bottom surface of said bottom wall further comprising a second array of bottom corrugations generated about a second array of bottom corrugation axes aligned substantially orthogonal to the axes of said first array of bottom corrugation axes, said second array of bottom corrugations comprising a second bottom concave corrugation and a second pair of arcuately convex corrugations on opposite respective sides of said second bottom concave corrugation; a connecting wall extending upwardly from said first end of said bottom wall; and a top wall projecting from said connecting wall in spaced substantially parallel relationship to said bottom wall, said top wall comprising a top surface facing away from said bottom wall, said top surface of said bottom wall comprising at least one array of top corrugations thereon, said array of top corrugations comprising a concave tip corrugation and a pair of arcuately convex top corrugations on opposite respective sides of said top concave corrugation.

7. A golf accessory for supporting a cigar having a selected ring size corresponding to a selected radius, said accessory comprising:

a bottom wall having opposed first and second ends, a generally planar top surface and an opposed bottom surface, portions of said bottom wall adjacent said second end defining a pair of turf repair tines;

a connecting wall extending upwardly from portions of said bottom wall adjacent said first end; and a top wall projecting from said connecting wall in spaced relationship to said bottom wall, said top wall including a generally planar bottom surface extending substantially parallel to said top surface of said bottom wall, said top wall further comprising a top surface having a first array of corrugations comprising an arcuately concave corrugation extending entirely across said top wall and defining a radius capable of being substantially equal to the radius corresponding to the selected ring size, said first array of corrugations further comprising a pair of arcuately convex corrugations on opposite respective sides of the concave corrugation of said first array, said top surface further comprising a second array of corrugations intersecting said first array, said second array of corrugations comprising a second arcuately concave corrugation extending entirely across said top wall and a second pair of arcuately convex corrugations on opposite respective sides of said second concave corrugation.

8. The accessory of claim 7, wherein the corrugations of said first array are generated about axes substantially parallel to one another and substantially transverse to said tines of said elongate bottom wall, and wherein the corrugations of said second array are generated about axes aligned substantially orthogonal to the corrugations of said first array.

9. The accessory of claim 8, wherein the bottom surface of said bottom wall includes at least one array of corrugations on portions thereof spaced from said tines, said array of corrugations on said bottom wall comprising a bottom concave corrugation extending entirely across said bottom wall and defining a radius capable of being substantially equal to the radius corresponding to said selected ring size, said array of corrugations in said bottom wall further comprising a pair of arcuately convex corrugations disposed respectively on opposite respective sides of said bottom concave corrugations.

10. The accessory of claim 9, wherein said at least one array of corrugations formed in said bottom wall define a first array of bottom corrugations and wherein said bottom wall further comprises a second array of bottom corrugations intersecting said first array, said second array of bottom corrugations comprising a second bottom concave corrugation and a second pair of arcuately convex corrugations disposed respectively on opposite sides of said second bottom concave corrugation.

11. The accessory of claim 10, wherein said connecting wall further includes a concave outwardly facing surface defining a radius capable of being substantially equal to the radius corresponding to the selected ring size.

12. The accessory of claim 11, further comprising a ball marker removably connected to said bottom wall.

* * * * *